United States Patent [19]

Howard

[11] 3,990,250

[45] Nov. 9, 1976

[54] METHOD AND APPARATUS FOR CONSTRUCTION OF RETAINING WALLS

[76] Inventor: William E. Howard, 1715 E. Ocotillo, Phoenix, Ariz. 85016

[22] Filed: Mar. 17, 1975

[21] Appl. No.: 558,942

[52] U.S. Cl. ..... 61/39; 61/49

[51] Int. Cl.[2] ..... E02B 3/04

[58] Field of Search ..... 52/169, 742; 61/37, 61/39, 49; 264/31

[56] References Cited

UNITED STATES PATENTS

| | | | |
|---|---|---|---|
| 1,900,205 | 3/1933 | Sherrill | 61/39 |
| 3,768,266 | 10/1973 | Glenn | 61/37 |

*Primary Examiner*—Paul R. Gilliam
*Assistant Examiner*—David H. Corbin
*Attorney, Agent, or Firm*—Drummond, Nelson & Ptak

[57] ABSTRACT

A method for constructing retaining shore line walls in situ having the appearance of natural rock formations is disclosed. The method comprises excavating a trench in the desired location. At least one trench side wall is scraped or carved during excavation so that predetermined impressions are formed in the side wall. Cementitious material is poured in the trench and the side wall impressions are transferred to the concrete resulting in a rock-like appearance wall when the adjacent soil is removed. An apparatus adapted for attachment to a conventional trencher is also disclosed which carves or cuts the forming impressions during excavation of the trench.

5 Claims, 9 Drawing Figures

METHOD AND APPARATUS FOR CONSTRUCTION OF RETAINING WALLS

The present invention relates to a construction method and apparatus. More particularly, the present invention relates to a method of constructing walls for retaining bodies of water and a trenching machine for excavating the same.

The construction of artificial bodies of water for recreational use and in connection with development of residential projects has become commonplace. Construction of such artificial bodies of water requires installation of some means for retaining the water and controlling erosion at the shore line of the body of water. Control of seepage to minimize water loss and resistance to wave action is also a requrirement. Accordingly, it is conventional practice to erect shore line retaining walls peripherally around such bodies of water.

A number of methods have been utilized in the prior art to construct shore line walls for erosion and seepage control. It has been suggested to simply cover a part of the exposed and submerged shore line with suitable erosion resistant covering. Materials used for this purpose include rip-rap, cementitious materials such as concrete and synthetics such as polyvinyl plastics. These methods have not proved entirely satisfactory in that they do not control erosion sufficiently and costs of construction become substantial. Further, coating artificial bodies of water or ponds with synthetic materials such as the polyvinyl sheeting is not practical in the case of recreational uses. Neither do these methods result in a shore line having any substantial aesthetic appeal.

It has also been suggested in the prior art to construct retention walls using conventional pilings or members such as are used in the construction of coffer dams or diversion dams. These are often installed with edge interlocking members which are suitably braced. However, the cost of construction of retaining structures of this type is substantial rendering them prohibitive for many projects. Further, structures of this type do not have an appearance consistent with recreational and residential development uses.

In order to avoid the disadvantages cited above and to achieve economy of construction, it has been proposed in the prior art to construct shore line walls for retaining artificial bodies of water by excavating a trench defining the shore line of the body of water. A pre-molded plastic form is then positioned within the trench, the form having an appropriate surface treatment. Concrete is poured into the trench to fill the trench. The plastic form is thereafter removed from the trench and concrete in contact with the plastic section will have irregular surface which is the mirror image of the surface of the plastic form. This method represents an advance over the prior art in that a natural rock-like formation emerges as the shore line for the body of water.

While the aforementioned method of constructing shore line walls for retaining bodies of water represents a distinct advance of the state of the art, nevertheless certain drawbacks exist with such a system. Construction of a natural appearing retaining wall by this method still requires the use of expensive forms which must be transported to the job site and laboriously inserted in the appropriate trench excavation. Once the pouring of the wall has been completed, the mold must be removed and a portion of the trench excavated to expose the face of the wall. Thus, even with this method it is necessary to incur the expense of buying or renting forms and installing them properly in the trench and removing them after the cementitious material has properly hardened.

Accordingly, the above cited disadvantages of the prior art are overcome by the present invention which provides an economical and efficient method and apparatus for constructing shore line retaining walls for bodies of water. The completed wall is aesthetically appealing having the appearance of a naturally occuring rock formation.

In acordance with the present invention, the method comprehends excavating a trench of predetermined dimensions in the outline or along the periphery of the intended shore line. The inner trench side wall is formed having predetermined surface irregularities simulating the features of a natural, rock-like wall. An appropriate cementitious material is then poured into the trench. The earth adjacent the interior trench wall is removed after the concrete has hardened. The concrete exposed to the surface of the interior trench wall will take on the appearance of a natural rock-like material.

The present invention also relates to an excavating apparatus especially adapted to excavate the trench wall in the required configuration. The trenching apparatus includes a boom adapted for attachment to a prime mover having an endless conveyor or excavating line carried on the boom. A cutting plate is adjustably secured laterally of the boom. The opposite side of the boom carries an appropriate drag shoe which holds the blade in tight engagement with the inner trench wall. As the conveyor is actuated, the cutting blade scrapes or cuts away the soil at the inner side of the trench forming an impression in the soil which simulates a natural rock-like appearance.

Thus, it is a primary object of the present invention to provide a method for constructing a retaining wall with the appearance of a natural occurring shore line in situ. It is also an object of the present invention to provide a novel trenching apparatus for excavating a trench having a side wall provided with a surface pattern which serves as a form for the resulting wall.

Other objects and advantages of the present invention will become apparent from consideration of the following detailed description in which.

Figure 5A:
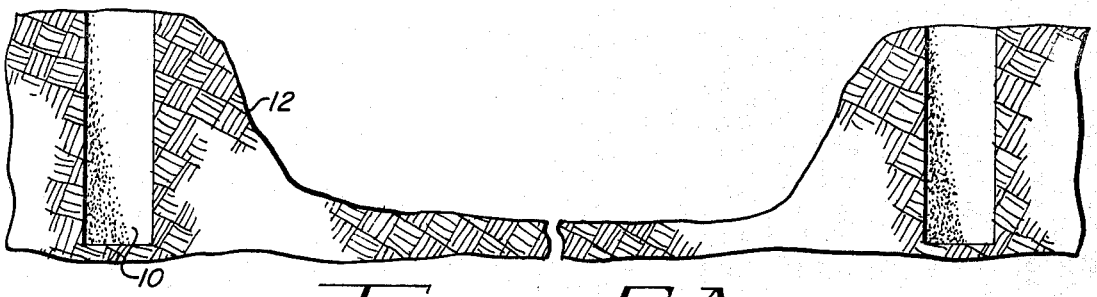
FIGS. 5A through 5C illustrate the conventional prior art method of constructing a natural appearing shore line for an artificial body of water.
Figure 5B:
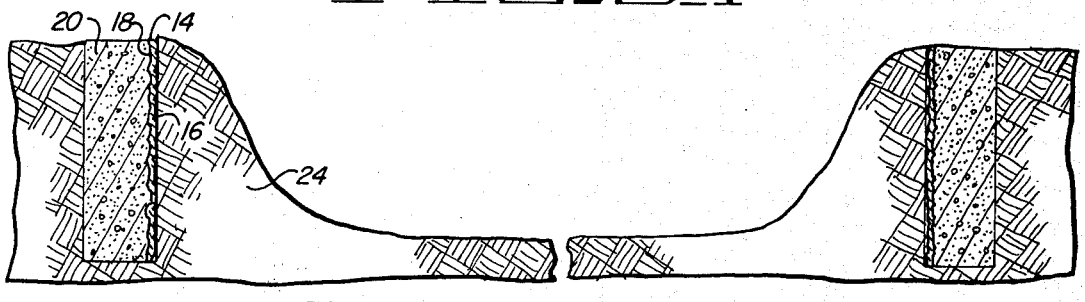
Figure 5C:
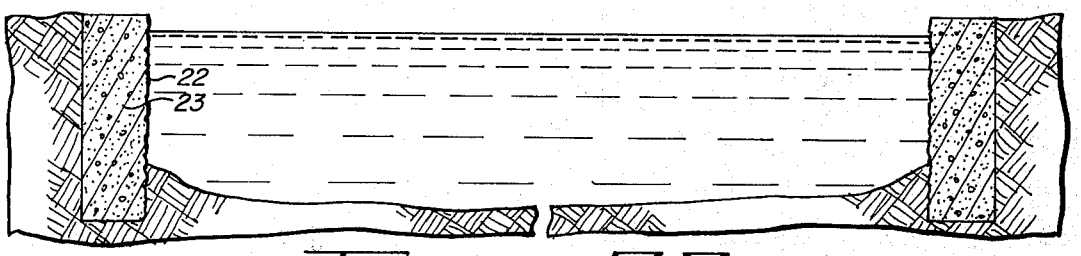
FIG. 5C PRIOR ART

In order to better understand the method of the present invention, a brief summary of the prior art is believed helpful. Referring particularly to FIGS. 5A through 5C, the prior art method of constructing a shore line for artificial bodies of water is shown. By means of conventional trenching equipment, a generally rectangular trench 10 is excavated to form the periphery of the basin 12 of the water body to be subsequently retained within the wall. Upon completion of excavation of trench 10, an appropriate mold or form 14 is secured against the interior wall 16 of trench 10. The form can be of any suitable length and of any suitable material, such as metal or plastic. The form is secured in the trench by appropriate fastening means, not shown. Form 14 is provided with a surface 18 which is irregular and carries an appropriate design. After a number of the forms 14 are secured in the trench, a release agent, such as a silicone coating, is applied to the surface of the mold. Concrete 20 is poured into the trench void and allowed to harden. Once the concrete is hardened, the form can be removed and the concrete wall 23 will, as seen in FIG. 5C, have an appropriate surface 22 imparted in it. It is then necessary to excavate the soil 24 adjacent the inner side wall surface 22 so as to expose surface 22. It then becomes necessary to transport the removed mold or form 14 from the job site to a new location for reuse.

Figure 6A:
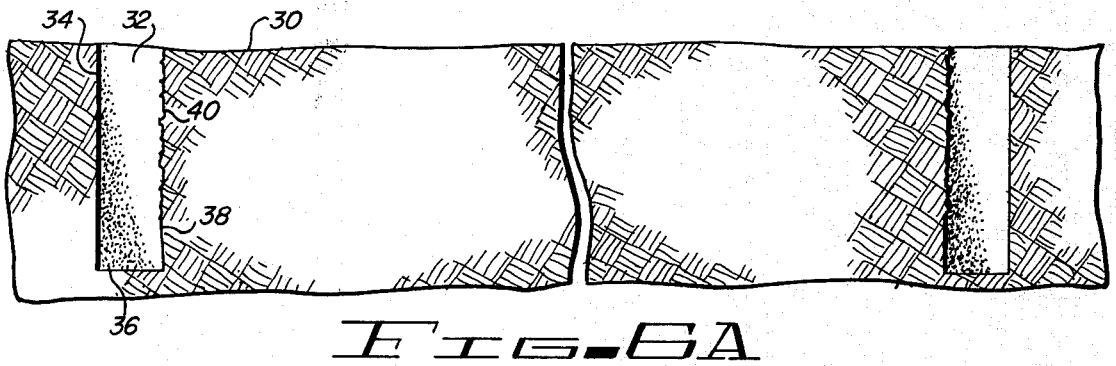
FIGS. 6A and 6B illustrate the novel method of the present invention for constructing a naturally appearing artificial shore line.
Figure 6B:
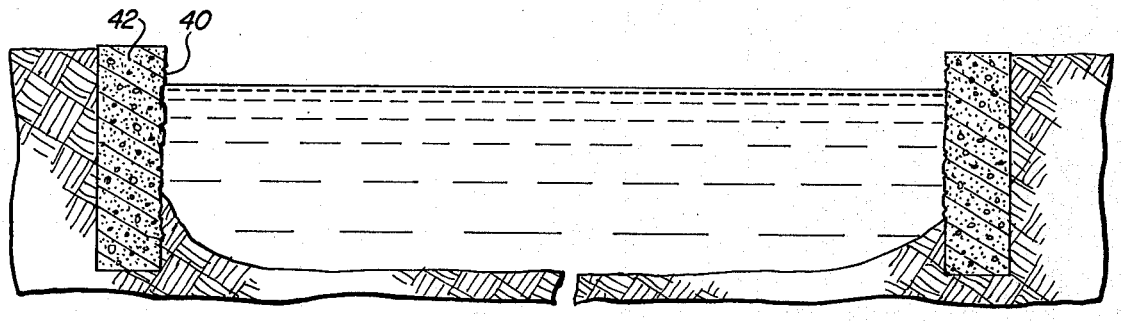

As pointed out above, the prior art method of constructing a shore line as described with reference to FIGS. 5A through 5C represents an advance in the state of the art. Nevertheless, the prior art method still involves the use of forms and the time and expense involved in installing the forms or molds and removing them is significant. Further, the costs of the forms, either purchased or as rentals, is a substantial cost factor in determining the lineal foot cost of construction of artificial shore line walls of the type described. The method of the present invention as shown in FIGS. 6A and 6B is relatively simple but represents substantial economy in the construction of an erosion resistant, naturally appearing shore line wall.

Referring to those figures, the numeral 30 generally represents a soil area in which an artificial lake or body of water is to be constructed. Generally in carrying out the method of the present invention, it is desirable that the soil in which the trench is to be placed be reasonably compact and have the characteristic of being excavatable without excessive collapse or deterioration of the trench side walls. Soils of this type include compact sand, gravels and clays while silt, mud and peat would generally not lend themselves to construction according to the method herein. Soil conditions consisting of caliche, a form of decomposed granite which is hard packed, is particularly suited to the method. This type of soil is commonly found in the Southwestern United States.

A trench 32 is excavated in a desired outline of the body of water to be retained. Trench 32 is preferably excavated by means of the novel excavating apparatus to be described hereafter. Trench 32 is generally rectangular having any desired dimensions in accordance with design requirements. Typically the trench 32 will be approximately 1 foot in width and have a depth of approximately 4 feet. Trench 32 has a generally vertical outer side wall 34, a bottom wall 36 and an inner vertical side wall 38. The term "interior" wall refers to the trench side wall which is adjacent the body of water to be subsequently retained. Interior side wall 38 is excavated becoming a transfer surface having surface indentations or irregularities 40 carved or scraped therein a predetermined pattern. The surface 40 may vary with the particular effect desired but typically will simulate formations of natural rock or sandstone in stratifications as often occurs. The surface pattern 40 may extend the full depth of the trench or part way if the resulting retaining wall will be only partially exposed. Normally, the latter will be the case as the lower wall portion will serve as a subterranean footing. Surface pattern 40 can be formed in the trenching operation or by a subsequent operation.

Once trench 32 has been completed in the outline of the desired body of water to be contained with side wall 38 provided with pattern 40, concrete or other cementitious material is then poured into the trench. It is preferred that the shore outline formed by trench 32 be irregular and random so as to more merely appear to have topographical similarities corresponding to a naturally occurring shore line. The cement is poured to completely fill the trench 32. An appropriate coloring agent may be added to the concrete to enhance the appearance and give the resulting wall structure coloration similar to naturally occurring rock common to the area. Upon hardening retaining wall 42 is formed. The earth defined within the wall 42 can be removed to the desired depth to form a basin. For example, the earth is excavated to expose the upper portion of the inner side wall. The exposed portion of wall surface 44 will have the coloration and appearance of naturally occurring rock having transferred to it the impression which had been previously carved in the trench wall. The use of molds, forms and release agents is completely obviated. The soil or earth itself is excavated to serve as a form to impart the desired impression or natural rock-like features in the surface of the resulting concrete wall 42. If colored concrete is not used, the exposed portion of wall 42 can be stained or colored by using commercially available water-proof concrete stains subsequent to sandblasting or steam cleaning.

Wall 44 effectively serves as a permanent retaining wall to resist erosion and seepage and will contain the water within the confines of the walls. The exposed portion of the retaining wall 44 has rock-like appearance which is aesthetically pleasing and gives a desired rustic, natural effect. It will be noted that although the method has primary application to the construction of walls for confining artificial bodies of water, the method can also be used in the construction of a wide variety of walls for structural, retaining, architectural or landscaping applications when a natural appearance is desired. In some instances both trench side walls may be scraped so that the resulting wall has a stone or rock-like appearance on both vertical side walls.

Figure 1:
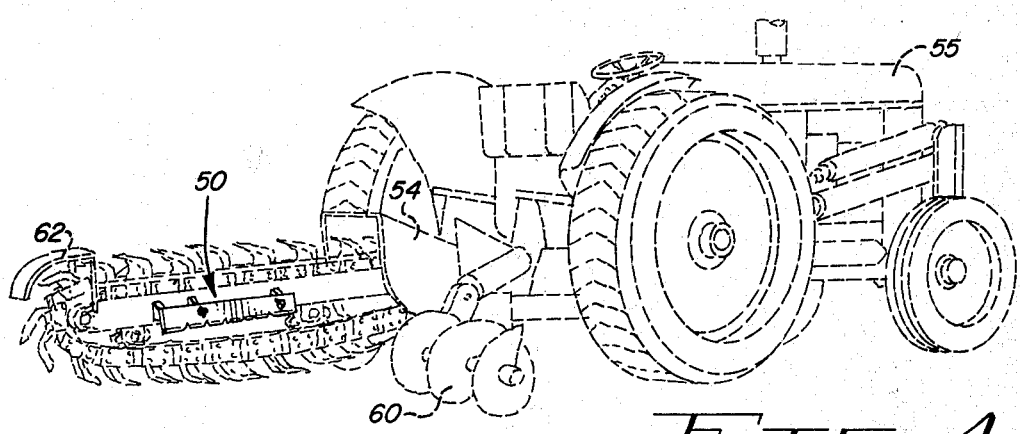
FIG. 1 is a perspective view of the trenching apparatus of the present invention carried on a tractor mounted trencher shown in dotted representation.
Figure 2:
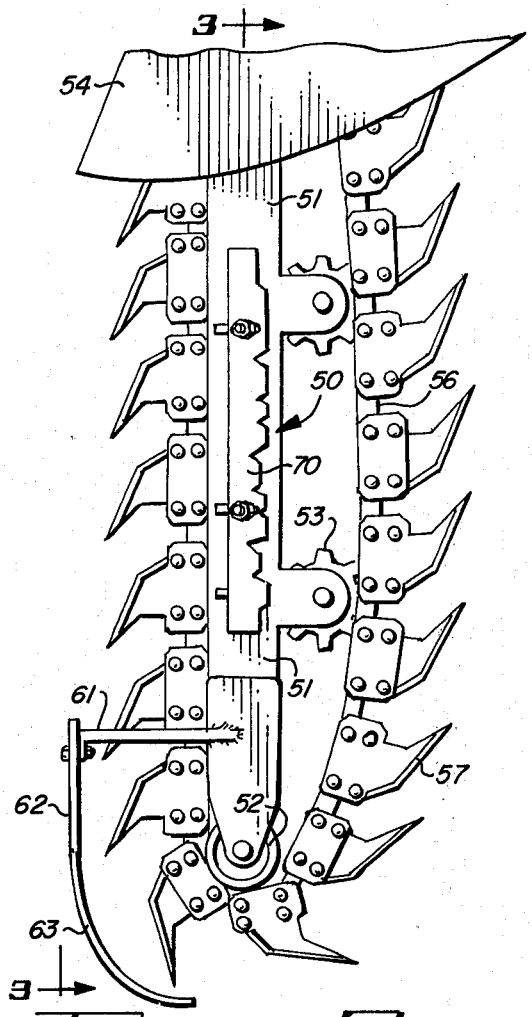
FIG. 2 is a side view illustrating the details of the trenching apparatus of FIG. 1.
Figure 3:
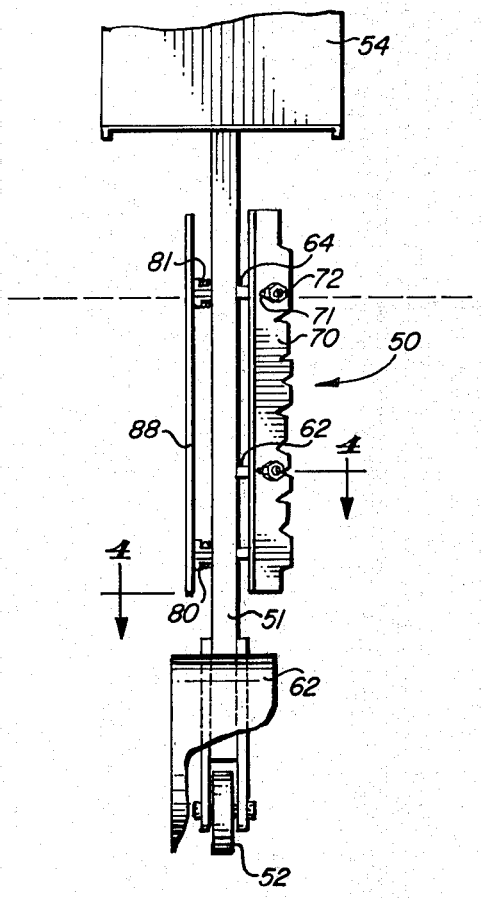
FIG. 3 is a sectional view taken along lines 3—3 of FIG. 2.

FIGS. 1 through 4 illustrate a trenching apparatus especially adapted for excavating a trench and at the same time forming the desired side wall impressions which impart the natural rock-like appearance to the resulting retaining wall. As seen in FIGS. 1 to 3, the excavating apparatus generally designated 50 includes a longitudinally extending boom member 51 which carries a rotatable sprocket 52 at its terminal end. Another sprocket, not shown, is mounted beneath shroud 54 at the head end of the boom. Boom 51 is carried on a suitable frame which is adapted to be attached to the tool bar of a prime mover such as a tractor 55 shown. An endless conveyor or trenching chain 56 extends longitudinally about the sprockets 52 and idler sprockets 53. The conveyor chain 56 is appropriately driven by a hydraulic drive motor or by a power take-off unit from the towing vehicle 55. As is conventional, the boom is pivotal to different digging positions and depths by extensible hydraulic cylinders, not shown.

Excavating buckets or teeth 57 are spaced at predetermined intervals along the conveyor chain and in known fashion serve to excavate and remove dirt. The teeth 57 scoop up the dirt depositing the dirt along the edges of the trench. An auger 60 carried near the head of boom 51 laterally discharges the removed soil. Various lengths of augers are available for deep cuts and undercuts.

A shield 62, often termed a "crumbing shoe", may also be carried on the boom member to prevent dirt from accumulating in the bottom of the trench and keeping any loosened dirt within the influence of the conveyor teeth 57. Shield 62 includes a curved cover 63 mounted on boom 51 by bracket 61 which partially shields the lower sprocket 52 of the boom. The general trenching apparatus described above consisting of a teeth carrying trenching chain carried on a boom is conventional and has been described only as being representative of the type of device to which the invention is applicable. It should be noted that the improvement described herein can be adapted to use with other types of trenching apparatus such as a wheel, ladder or stringer type trencher.

Figure 4:
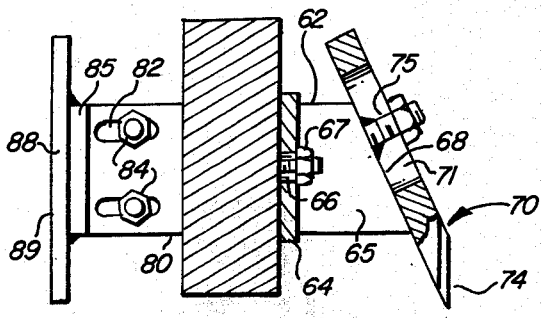
FIG. 4 is a sectional view of the blade and drag shoe taken along lines 4—4 of FIG. 3.

The improvement consists of means for forming a side wall of a trench having surface variations which will be imparted to concrete subsequently poured in the trench to form a simulated rock-like wall. As best seen in FIGS. 3 and 4, one side of boom 51 carries a pair of laterally projecting mounting brackets 62 and 64 which are longitudinally spaced apart an appropriate distance. Each of the mounting brackets is in the shape of a tee having oppositely extending flange 64 and projecting stem 65. Flanges 64 each have a longitudinally extending slot 66 through which stud 67 attached to the boom extends. Brackets 62 and 64 are longitudinally adjustable relative to boom 51 by means of slots 66. Mounting surface 68 of stem 65 is inclined with respect to boom 51. Stud 75 is welded to surface 68 of brackets 62 and 64. An elongated cutting blade 70 is mounted on surface 68 of brackets 62 and 64 with studs 75 projecting through laterally extending slots 71.

The angular mounting of blade 70 with respect to the boom is preferred since the blade then forms an acute angle with respect to a vertical trench wall in a cutting position. This angular and inclined blade altitude improves the precision with which one desired pattern can be cut or scraped in the trench side wall. Blade 70 is formed with a cutting edge 74 having predetermined irregularities of serrations formed in the edge. It will be seen that, blade 70, is adjustable so that the effective distance of edge 74 from the boom can be varied by adjusting slot 71 along studs 75. Thus, the construction of the blade and bracket assembly is versatile permitting blade 70 to be adjusted longitudinally with respect to boom 51 and laterally with respect to the boom for various conditions. In a trenching position, blade 70 is inclined with the trench wall to achieve better cutting and scraping characteristics.

The opposite side of boom 51 carries another pair of brackets 80 and 81 each carrying a pair of laterally extending slots 82. Pad or shoe 88 extends longitudinally along the boom and has a bearing face 89 substantially parallel to boom 51. The underside of shoe 88 carries a bracket 85 which has elongated slots that generally align with slots 82 of brackets 80 and 81. Bracket 85 is secured to bracket 80 by means of bolts 84. It will be noted that the effective position of shoe 88 can be varied by adjusting bracket 85 relative to bracket 80.

In operation boom 51 attached to tractor 55 is hydraulically lowered into a trenching position in which boom 51 is inclined with respect to the ground level. As the tractor 55 is advanced with the trenching chain 56 engaged, teeth 57 excavate a trench and auger 60 deposits the removed soil at the surface at either side of the vertical trench wall. The formed trench is generally rectangular in vertical cross section. The vertical side wall 34, which will be the outer wall of the retaining wall, is engaged by the drag shoe assembly 88 to prevent disengagement of the cutting blade to form the opposite wall 38. Side wall 38 is engaged by the serrated cutting edge 74 of blade 70 with the blade forwardly inclined into the wall. The serration in cutting edge 74 scrapes or cuts an irregular pattern in the side wall to about a depth of 2 feet. The pattern scraped into side wall 38 simulates layers or strata of naturally occurring rock. Further, as the trencher advances slight vertical undulations will be imparted to the boom which will further give the side wall a random appearance, simulating naturally occurring rock.

It will be obvious that the blade configuration can be changed to accommodate various soil characteristics and to result in various patterns being scraped into the trench side wall.

As pointed out above, with regards to FIGS. 6A and 6B, once the excavation operation is completed and a trench has been continuously formed in the outline of the body of water the pouring operation can proceed. After the resulting wall 42 is hardened, soil at the inner wall side is removed to expose wall surface 44 having the appearance of naturally occurring rock.

Thus, it will be seen that the present invention provides a new and novel method for constructing retaining walls for artificial bodies of water. The method eliminates the need for any expensive molds or forms. Instead, the necessary impressions are formed simultaneously with the trenching process in situ. The word "simultaneous" as used herein and in the claims means that the side wall of the trench is scraped at the time the trench is excavated in a single operation rather formed in a second, subsequent operative step. The resulting wall has the appearance of a natural rock-like structure. The method can be expediently and economically carried out by means of an improvement adaptable for use with conventional trenching machines.

It will be obvious to those skilled in the art to make various changes, alterations and modifications to the embodiments herein described. To the extent that these alterations, changes and modifications do not depart from the spirit and scope of the appended claims, they are intended to be encompassed therein.

I claim:

1. A method for constructing a retaining wall having a natural rock-like appearance in a compact soil in situ without installation of forms, said method comprising the steps of:

a. excavating a trench in the soil with a trenching apparatus, said trench having first and second spaced apart substantially vertical sidewalls;

b. scraping at least a portion of said first trench sidewall with a scraping tool carried on said trenching apparatus having a cutting edge whereby a scraped transfer surface is formed on said first sidewall, said transfer surface having surface irregularities therein simulating a rock-like surface;

c. pouring cementitious material into said trench to at least partially fill the trench and fill the surface irregularities in the scraped transfer wall portion;

d. allowing the cementitious material to set forming a wall with the resulting hardened wall portion adjacent the transfer surface imparted with a natural appearing rock-like surface; and e. excavating the soil at said first trench sidewall to expose the wall portion having the surface pattern imparted therein.

2. The method of claim 1 wherein said retaining wall is a shore line wall constructed to at least partially surround a body of water.

3. The method of claim 1 wherein said surface pattern simulates naturally occurring rock.

4. The method of claim 3 further including the step of coloring said cementitious material.

5. A retaining wall having a natural rock-line appearance constructed in situ without installation of forms by the following steps:

a. excavating a trench in the soil with a trenching apparatus, said trench having first and second spaced apart substantially vertical sidewalls;

b. scraping at least a portion of said first trench sidewall with a scraping tool carried on said trenching apparatus having a cutting edge whereby a scraped transfer surface is formed on said first sidewall, said transfer surface having surface irregularities therein simulating a rock-like surface;

c. pouring cementitious material into said trench to at least partially fill the trench and fill the surface irregularities in the scraped transfer wall portion;

d. allowing the cementitious material to set forming a wall with the resulting hardened wall portion adjacent the transfer surface imparted with a natural appearing rock-like surface; and excavating the soil at said first trench sidewall to expose the wall portion having the surface pattern imparted therein.

* * * * *